US005704591A

United States Patent [19]

Byrne

[11] Patent Number: 5,704,591

[45] Date of Patent: Jan. 6, 1998

[54] FASTENER PULLER

[75] Inventor: Brian T. Byrne, Chanhassen, Minn.

[73] Assignee: Garlock Equipment Company, Minneapolis, Minn.

[21] Appl. No.: 522,968

[22] Filed: Sep. 1, 1995

[51] Int. Cl.[6] ..... B25C 11/00

[52] U.S. Cl. ..... 254/18

[58] Field of Search ..... 254/18, 19, 20, 254/21, 22, 25, 26 E, 27, 93 R; 29/244, 252, 281

[56] References Cited

U.S. PATENT DOCUMENTS

| | | | |
|---|---|---|---|
| 643,512 | 2/1900 | Lubbock . | |
| 742,111 | 10/1903 | Beard et al. | 254/30 |
| 812,701 | 2/1906 | Stiner . | |
| 888,841 | 5/1908 | Naudain . | |
| 1,167,574 | 1/1916 | Lechner . | |
| 1,782,506 | 11/1930 | Henderson . | |
| 2,151,304 | 3/1939 | Schultheiss . | |
| 2,776,108 | 1/1957 | Sherman . | |
| 2,797,889 | 7/1957 | Talboys . | |
| 2,900,169 | 8/1959 | White . | |
| 3,161,432 | 12/1964 | O'Leary | 254/132 |
| 3,358,967 | 12/1967 | Harmon | 254/30 |
| 3,643,918 | 2/1972 | Ellis . | |
| 3,875,643 | 4/1975 | Cramer . | |
| 3,978,576 | 9/1976 | Mustoe, Jr. . | |
| 4,050,545 | 9/1977 | Hunter | 254/93 R |
| 4,078,766 | 3/1978 | Saurwein . | |
| 4,796,861 | 1/1989 | Petty | 254/8 B |
| 5,076,448 | 12/1991 | Ballard | 254/8 B |
| 5,203,540 | 4/1993 | Lee | 254/8 B |

*Primary Examiner*—Robert C. Watson

*Attorney, Agent, or Firm*—Peterson, Wicks, Nemer & Kamrath, P.A.

[57] ABSTRACT

A fastener puller for pulling screws (38) and the like from a deck (39) or other workpiece that includes a base (10) having a planar base portion (11B, 11C) joined to an inclined base portion (14) to provide a fulcrum about which the base pivots to move the planar base portion parallel to the adjacent part of the deck as the claw (30), while extending between the insulation hold down plate (35) and the insulation (37) on the deck, is initially moved perpendicularly to the planar base portion by a piston cylinder combination (20, 21). The screw, in being removed, is moved perpendicularly to the part of the deck in which it is extended. The combination reciprocates a slider (24) along the slide mount (17B). The claw is mounted to the slider while the slide mount is mounted to the base to extend perpendicular to the planar base portion whereby the claw is moved to minimize the enlargement of the hole in the deck as the screw is separated from the deck.

21 Claims, 2 Drawing Sheets

FASTENER PULLER

BACKGROUND OF THE INVENTION

1. Field of the Invention

This invention relates to a portable power operated tool for pulling screws, nails and similar objects from a workpiece.

2. Description of the Prior Art

In flat roofs which use a single ply membrane, insulation and other layers are held on the roof deck, for example made of corrugated metal, by screws that extend through metal insulation hold down plates and threaded into the roof deck. Various building codes require that a certain number of such screws be utilized per square foot of roof area. For some larger buildings, the number of screws utilized may be many tens of thousands.

It is old to provide power operated tools to remove nails, bolts and spikes. For example, U.S. Pat. No. 2,797,889 to Talboys discloses a portable spike puller having a claw pivotally mounted to the lower end of a piston rod to move with the piston rod relative to a puller base portion while handles are mounted to the cylinder. While the puller is pulling a spike, the base abuts a tie plate, 25 which provides a hard metal surface.

With prior art equipment, probably the best approach for removing such screws is to utilize a power screwdriver to back the screws out of the deck. Alternately, the screws can be pulled out with a hammer. However this is less desirable because as the screws are pulled out, the screws are moved at an angle which undesirably enlarges the screw holes in the deck, for example elongates the hole. When utilizing a hammer for removing a very large number of screws, the user will be on his/her knees for a long period of time. Further, due to the compressibility of the insulation, when a hammer is used it sinks into the insulation layer. Another possibility is to shear off the heads of the screws, but often this is very dangerous since the portion of the screws extending through the deck frequently are projected from the roof deck downwardly into the building.

In order to overcome problems encountered in utilizing prior art tools, this invention has been made.

SUMMARY OF THE INVENTION

The screw puller includes a base having a generally planar bottom surface portion, a main body that for the most part, extends generally perpendicular to the base, a slide member mounted to the main body for being vertically reciprocally moved by a two way acting piston cylinder combination and a claw mounted to the slide member for movement therewith diametrically opposite the connection of the piston cylinder combination to the slide member. The claw, in being retracted, pulls the insulation hold down plate and screw vertically (perpendicular to the portion of the deck in which it extends) so as not to bend the screw and thereby unnecessarily further enlarge the hole in the deck in which the screw extends.

One of the objects of this invention is to provide new and novel means for pulling a screw and an insulation hold down plate vertically from a roof deck. A further object of this invention is to provide new and novel power operated means on a screw puller main body that is operable to vertically reciprocate a claw. Another object of this invention is to provide a new and novel base on a screw puller to facilitate moving the puller claw beneath the screw head which then is tiltable to a position whereby the screw is vertically withdrawn from its embedded condition by retraction of the claw. A different object of this invention is to provided a fastener puller having a new and novel base usable on a non-rigid overlaying material layer to minimize the amount of compression of said material which a fastener which extends therethrough and into an underlaying support is being pulled

DETAILED DESCRIPTION

Figure 1:
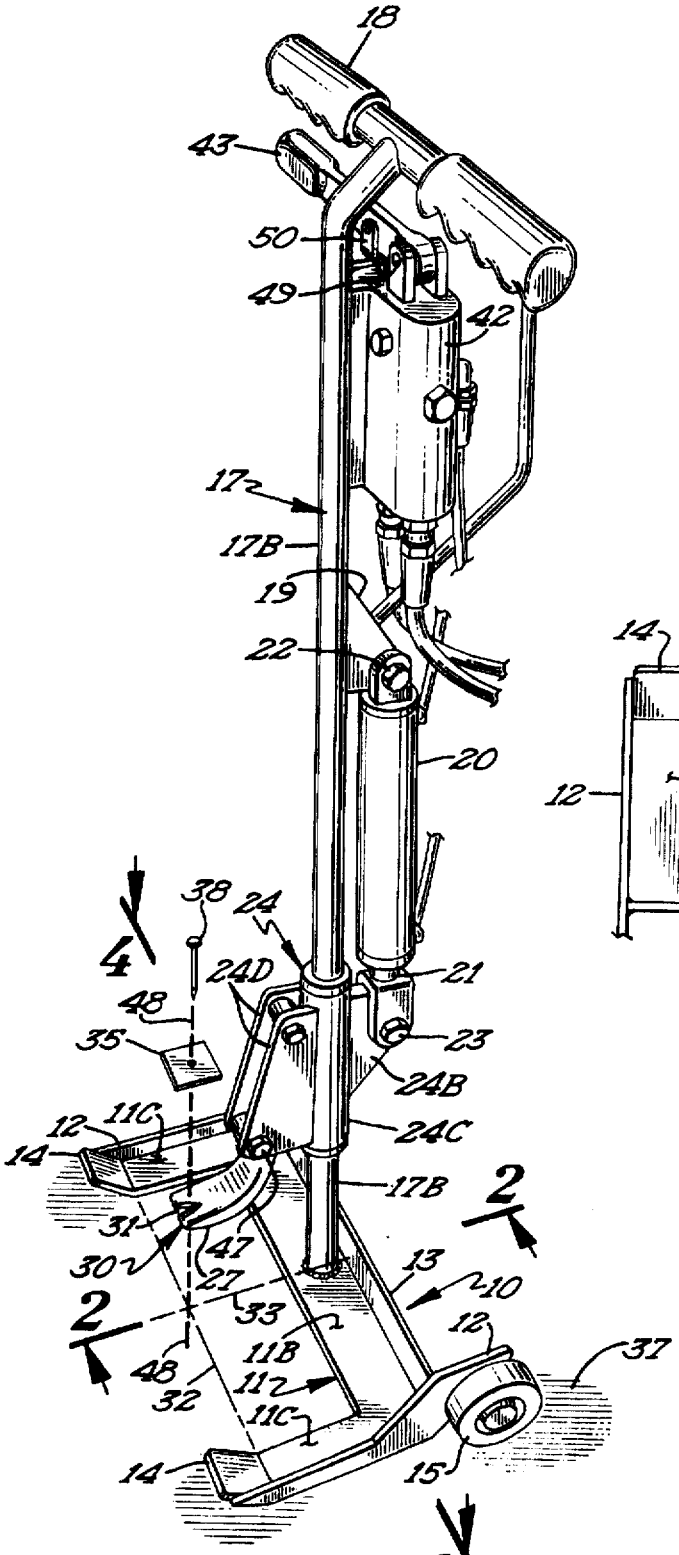
FIG. 1 is a perspective view of the screw puller of the invention with the puller claw in a retracted position.
Figure 4:
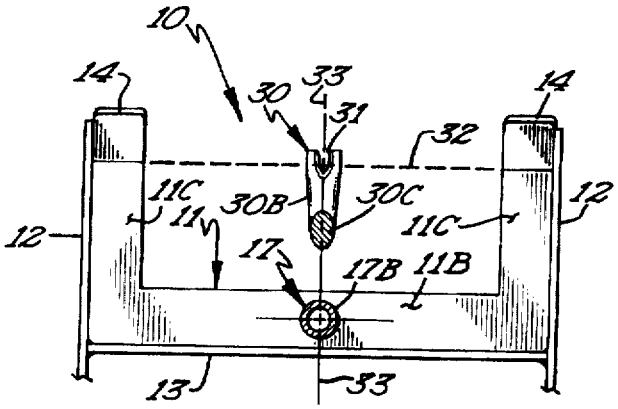
FIG. 4 is a fragmentary horizontal cross sectional view that is generally taken along the line and in the direction of the arrows 4—4 of FIG. 1, the part of the base side flanges extending rearwardly of the base member not being shown.

Referring in particular to FIGS. 1 and 4, the screw puller of this invention includes a base (skid), generally designated 10, having front end portions and rear end portions. The base includes a base member 11 which in plan view is generally U-shaped. That is, the base member has a generally rectangular cut-out to form a rear transverse web 11B which at its transverse opposite ends is joined to rear ends of the parallel, longitudinally elongated legs 11C. The bottom surfaces of the web and legs (base member) are coplanar. The front edges of the legs are joined to the rear edges of the forwardly and upwardly inclined flanges 14 at an obtuse angle relative to the legs, for example about 135 to 150 degrees relative to the legs.

To the transversely remote edge portions of the base member to extend thereabove and to the inclined flanges, there are joined side flanges 12 that extend upwardly and rearwardly of the web. Further, a reinforcing, foot pushable, transverse flange 13 is joined to the side flanges and to the web to extend thereabove. To the rear part of each of the side flanges which extends rearwardly of the web, there is mounted a wheel 15. The wheels are mounted to be above the plane of the base member.

The screw puller also includes a vertically elongated main body 17 joined to the web. Advantageously, the main body may be in the form of a rod with nearly its entire lower portion (slide mount) 17B extending perpendicularly to the web and transversely centered relative to the web. Joined to the upper rearwardly bent portion of the main body is a transversely extending handle 18, the bent portion being joined to the upper end of the slide mount. Desirably, the slide mount is of an elongated dimension to have the handle located at about the same elevation as the waist of the average user when the slide mount extends at ninety degrees relative to the surface of the insulation. The axis of rotation of the wheels 15 is rearwardly of the slide mount.

Affixed to the vertical intermediate part of the body portion 17B is a bracket 19 which has the upper end of a two way acting cylinder 20 of the piston cylinder combination 20, 21 pivotally connected by a pivot member 22. The piston combination piston rod 21 is pivotally connected at 23 to the rear ear 24B of a slide member 24. The central axis of elongation of the piston rod as it is reciprocated is parallel to the central axis of elongation of the slide mount 17B.

The annular portion 24C of the slide member 24 is mounted to the slide mount 17B to form a close sliding fit therewith vertically below the bracket 19. Diametrically opposite the juncture of the rear ear to the slide member annular portion, are radially extending front ears 24D.

Mounted to the front ears 24D of the slide member to move therewith is a claw, generally designated 30. The claw 30 has a front portion 30B that is forwardly of and at a lower elevation than the slide member and a shank 30C joined to the claw front portion to be arcuately curved to extend upwardly and rearwardly and thence upwardly to be mounted to the slide member in a fixed position relative thereto by pins 47. The front portion 30B has a generally V-shaped forwardly opening notch (slot) 31 that is defined by a screw engaging portion of the claw, the apex of which, as viewed in plan view, is substantially longitudinally aligned with the juncture of the inclined flanges to the legs 11C as indicated by line 32 when the slide mount extends perpendicular to the horizontal. Further, as viewed in plan view, the notch apex is longitudinally aligned with the center of the juncture of the slide mount 17B to the web as indicated by line 33 which extends perpendicular to the line 32. Thus, as viewed in side view, the claw notch apex is longitudinally spaced from the slide mount by the same distance that the juncture (fulcrum) of the inclined flanges to the front ends of the legs is spaced from the slide mount. Also, advantageously the line 33 is parallel to and substantially of equal distances from the adjacent longitudinal edges of the legs 11C. The claw front portion has a generally planar bottom surface 27 that converges toward the top surface 28 in a longitudinal forward direction to facilitate the movement of the claw front portion between an insulation hold down plate 35 and the insulation 37 for removing the screw 38 from the deck (workpiece) 39 in which the screws are partially embedded. The top surface 28 of the front portion of the claw is general planar and is parallel to the bottom surface of the base member 11.

Desirably, the minimum transverse spacing of the adjacent longitudinal edges of each of the legs 11C from line 33 is many times greater than the maximum transverse dimension of each of the hold down plates and the claw front portion, for example at least five to ten times that of the claw front portion. Further, desirably, the transverse dimension of each leg is substantially greater than the corresponding dimension of the front end portion of the claw while the longitudinal dimension of the web is about the same or greater than that of each of the legs. Accordingly, the area of the bottom surface of the base member is very large in comparison to the surface 27 and the portion of the claw arcuate surface that is extendable below the plane of the base member bottom surface. Further, the bottom surface 27 of the claw is spaced a substantial distance forwardly of the front transverse edge of the web, advantageously by a distance greater than the maximum transverse dimension of the claw and by a distance many times greater than the diameter of the screw that is to be pulled.

The piston cylinder combination is operable to move the slide member along the slide mount and thereby, move the claw between an extended position whereby both of the top and bottom surfaces of the claw front portion are beneath the plane of the base member bottom surface, assuming said plane is horizontal, and a retracted position sufficiently vertically above base member that the hold down plate and screw are both entirely vertically above the insulation.

To control the application of fluid under pressure to the desired end of the cylinder, conventional control valve mechanism 42 is mounted to the main body 17 adjacent to the handle. An operating lever 43 is pivotally connected to the valve mechanism at 49 to extend adjacent to the handle whereby, while gripping one of the handle grips, one can pivot the lever from its datum position to a position closer to the gripped handle grip to move the link 50 upwardly. Moving the link upwardly moves the mechanism valve member (not shown) whereby fluid under pressure is applied from a conventional source (not shown), through the valve mechanism and to the lower end of the cylinder and permitting the upper end of the cylinder to exhaust fluid (the fluid connections and the exhaust not being shown) for moving the slide and thereby the claw front portion to an elevation so that the screw is entirely above the plane of the bottom surface of the base member 11. Prior to pivoting the lever in the above mentioned manner, the valve mechanism fluidly connects the lower end of the cylinder to the exhaust and applies fluid under pressure to the upper end of the cylinder to move the claw front portion top surface to be located below the bottom surface of the base member and below the bottom surfaces of the inclined flanges 14.

Preferably, when the slide mount 17B is vertical and the claw is reciprocated, the notch apex is moved along a vertical line 48 which is parallel to the slide mount and intersects the lines 32, 33 at their juncture to extend vertically and perpendicularly relative to each of lines 32, 33. Thus, the plane of lines 32, 33 is perpendicular to the plane of lines 33, 48. Further, the longitudinal spacing of the front edges of the legs from the front edge of the web 11B is the same as the longitudinal spacing of the line 48 from the front edge of the web. Advantageously, the front edge of the web is parallel to the plane of lines 32, 48.

Figure 2:
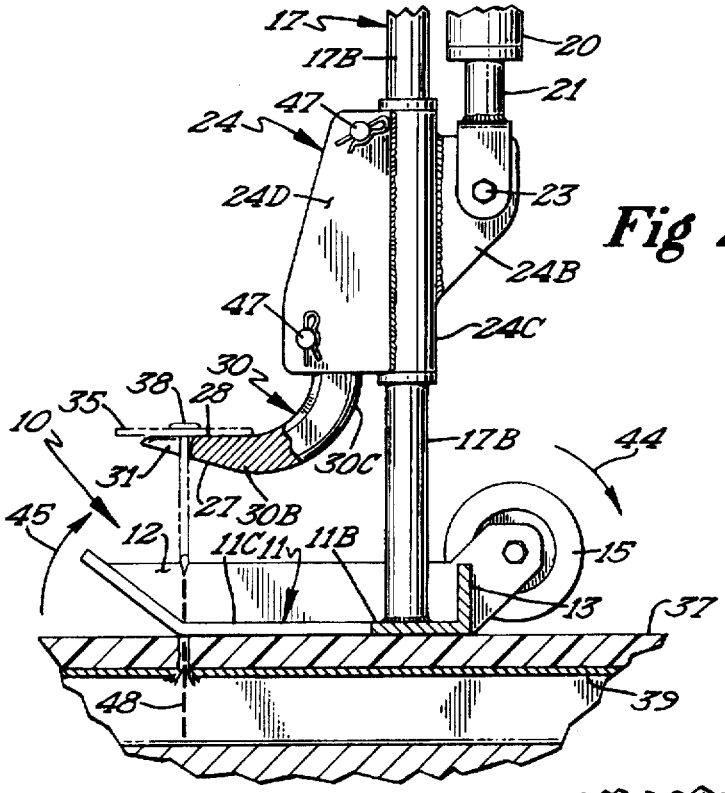
FIG. 2 is a fragmentary side elevational view, generally taken along the line and in the direction of the arrows 2—2 of FIG. 1, of the screw puller on a roof deck in its position of having just completed the pulling of a screw from the deck, the screw and insulation hold down plate being shown in dotted lines.

In using the screw puller of this invention, after a screw has been removed such as shown in FIG. 2 the upper end of the main body 17 is rearwardly pivoted in the direction of arrow 44 about the juncture of the reinforcing flange 13 and the base member 11, provided the claw is above the base member such as shown in FIG. 2, to a position so that the wheels abut against the insulation and the wheels may be the only part of the puller in engagement with the insulation. In the event the lever is allowed to return to its datum position, due to the application of fluid under pressure to the upper end of the cylinder, the piston rod is extended to move the claw front portion relative to the base member to extend below the base member. In the latter event, upon pivoting the handle rearwardly, the puller pivots about the arcuate surface of the claw with or without subsequently pivoting about the juncture of the base member to the reinforcing flange, in part depending upon the spacing of the claw front portion from the base member and the distance the web 11*b* extends rearwardly of the claw, until the wheels engage the insulation.

Figure 3:
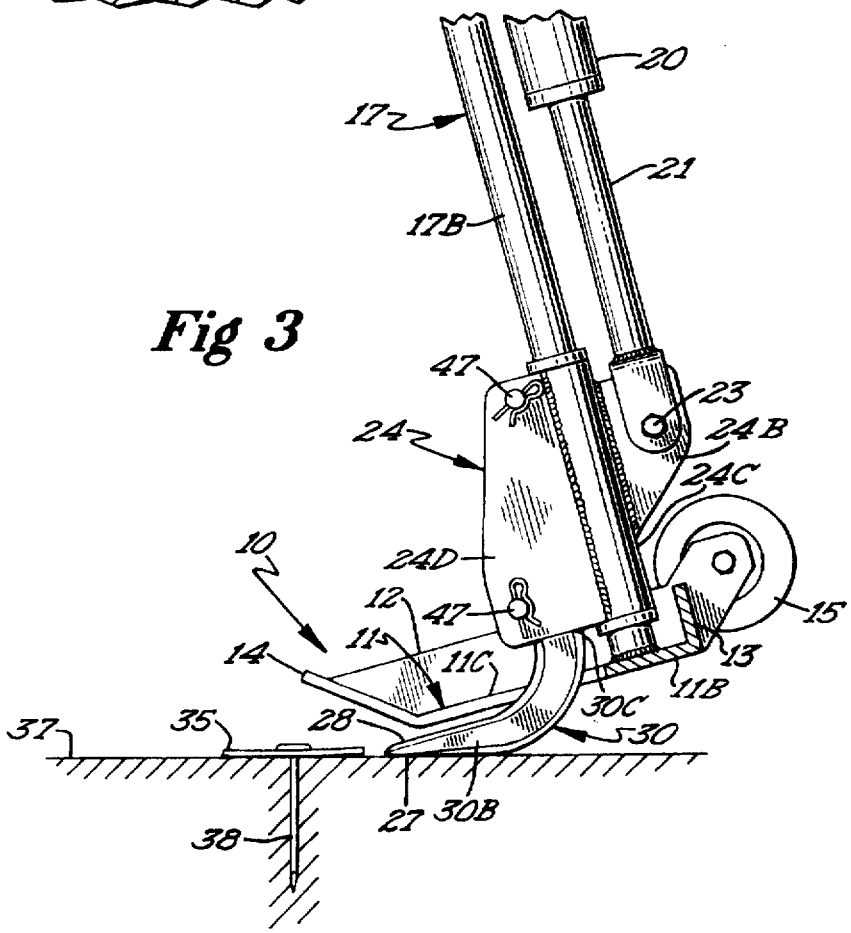
FIG. 3 is a fragmentary side elevational view of the screw puller with the puller claw in its extended position just prior to being moved to extend under the insulation hold down plate.

In either event, after the wheels engage the insulation, the puller may be easily moved to a location that the claw notch is aligned with and adjacent to the next screw to be pulled. Thence, the lever is operated to move the claw to its extended position of FIG. 3, if not already in its extended position, and the handle is pushed forwardly whereby puller is pivoted (rolled) about the claw arcuate surface to have claw bottom surface extend parallel to the hold down plate or slightly inclined downwardly in a direction toward the screw and the slide mount is tilted to extend upwardly and forwardly such as shown in FIG. 3. Now, the sole of the user's shoe may be positioned to exert a pushing force against the reinforcing flange to move the claw front portion forwardly to extend between the plate 35 and the insulation and the screw extends within the claw notch and is closely adjacent to the notch apex. Preferably, at this time the claw portion defining the notch may be in abutting relationship to the screw. Advantageously, the reinforcing flange in the FIG. 3 position may be engaged by the user's sole while the heel of the user's heel is still in engagement with the insulation.

When the screw puller is tilted such as shown in FIG. 3 and pushed forwardly to have the screw adjacent the notch apex, the base member and the inclined flange are convergingly inclined in a downward direction such that the juncture of the bottom surfaces of the inclined walls and the base is at a lower elevation than any other part of the base. Now, the lever is operated to apply pressurized fluid to the lower end of the cylinder to move the claw from its extended position to its retracted position of FIG. 2. The inclination of the inclined flanges facilitate the pushing of the base member forwardly without the base digging into the insulation.

During the initial retraction of the claw, the juncture of the base member and the inclined flanges are moved downwardly to initially engage the insulation at or closely adjacent to the line 32. Thence, due to the claw notch apex being located diametrically opposite the slide mount 17B from the connection of the piston rod connection to the slide member and substantially perpendicular aligned to line 32, as the slider is retracted, the base member pivots about the juncture of the inclined flanges and the base member (fulcrum) in the direction of arrow 45 until the base member is in substantially flat abutting relationship to the insulation. Thus, the base has a pivot edge (fulcrum) with the base pivot axis being the line 32, i.e. at the juncture of the legs with the inclined flanges. The pivotal movement about the fulcrum occurs without any rearward pivotal force being applied to the handle by the user. Thence, with further retraction, the screw and the hold down plate are moved vertically upwardly to a position out of engagement with the deck and insulation. Upon the claw notch apex extending adjacent to the screw and thereafter as the slide member is retracted, the screw is moved vertically upwardly and not at an angle inclined to the vertical, nor bent, whereby the screw hole in the deck would be enlarged beyond the diameter of the screw threads that were in engagement with the deck.

With the fastener puller of this invention, when used for pulling screws or nails that extend through insulation on decks, the base member provides a very large area for abutting against the insulation in comparison to the bottom area of the claw that abuts against the insulation during use while the front portion of the claw is substantially spaced from the base member. As a result, while a screw is being pulled, the downwardly force of the base member is spread over a larger area that is substantially spaced from the claw front portion and thereby decrease the amount of sinking of the base member into the insulation layer and the amount of compression of the insulation. Further, the provision of the base having a very large area, enhances the stability of the tool during use. That is, the area of the base member is many times greater than area of the bottom surface of the claw that is abutable against the insulation during use, for example at least five to ten times as great. With reference thereto, it is noted that the insulation is much more yieldable or compressible than the deck which is made of rigid material.

Even though the puller of this invention has been described with reference to pulling the combination of insulation plates and screws, it is to be understood that it can be used to remove other objects, for example screws without being extended through plates such as insulation hold down plates, nails, spikes and other like objects, as long as the claw front portion can be pushed to extend between the object head and the deck or other type of workpiece in which the object is partially embedded. Also it is to be understood that in the event that no insulation plate extends between the object head and the workpiece, the claw front portion would engage the head as the object is being pulled.

Additionally, it is to be understood that the power operated means for moving the slider between its positions may be electrical, pneumatic or hydraulic.

I claim:

1. A fastener puller for pulling a screw or a similar object having a head from a deck or another workpiece, comprising a longitudinally and transversely extending base, an elongated main body joined to the base to extend vertically upwardly, a claw and power operated means mounted to the main body for vertically reciprocating the claw between an extended position adapted for extension between the object head and the workpiece and a retracted object removed position, the base including transversely spaced, longitudinally elongated first and second legs having front end portions, and inclined first and second flanges Joined to the respective first and second leg front end portion to extend forwardly and upwardly relative to the legs, the claw, in its extended position, in part extending between the legs and being transversely spaced from the legs.

2. The fastener puller of claim 1, wherein the claw includes a front portion having a forwardly opening notch, the claw front portion having a maximum transverse dimension, and the legs have adjacent longitudinally extending edges that are transversely spaced from each other by a dimension that is many times greater than the claw front portion maximum transverse dimension.

3. The fastener puller of claim 1, wherein the legs have bottom surfaces that are substantially in a common plane, the main body includes an elongated slide mount joined to the base to extend perpendicular to said common plane of the legs, and the power operated means includes a slide member mounted to the slide mount for reciprocal movement between a claw extended position and a claw retracted position, the claw being mounted to the slide member for movement therewith, and a piston cylinder combination mounted to the main body and connected to the slide member for reciprocating the slide member between its positions.

4. The fastener puller of claim 3, wherein the slide member includes an annular portion having the slide mount extended therethrough, an ear joined to the annular portion to extend radially outwardly therefrom and having the piston cylinder combination connected thereto and a claw mounting portion joined to the annular portion to extend outwardly therefrom diametrically opposite said ear.

5. The fastener puller of claim 3, wherein the claw includes a forwardly opening notch having an apex, the claw apex being moved along a straight line perpendicular to said common plane as the claw is moved by the slide member moving between its positions, and the junctures of inclined flanges to the legs and line of the claw apex movement are contained in a plane that is at least substantially perpendicular to said common plane.

6. The fastener puller of claim 3, wherein the base includes side flanges joined to the legs and extend above the bottom surfaces of the legs, said side flanges having rear portions extending rearwardly of the legs, and wheels are mounted to the side flange rear portions, said wheels being above the common plane.

7. The fastener puller of claim 6, wherein the legs have rear end portions, the base includes a web extending between and joined to leg rear end portions and having a bottom surface generally coplanar with the leg bottom surfaces and a foot pushable transverse flange joined to the side flanges, the web and the side flange extending above said common plane.

8. A fastener puller for pulling a screw or a similar object having a head from a deck or another workpiece, comprising, in combination: a longitudinally and transversely extending base member having a front end portion and a rear end portion to define a cut-out, said base member having a generally planar bottom surface, first means joined to the front end portion for providing, at the juncture to the front end portion, a transverse fulcrum to facilitate the base member being pivoted from a generally horizontal position to a position to extend rearwardly and upwardly, an elongated slide mount joined to the base member rear portion to extend generally perpendicularly upwardly relative to the base member bottom surface, vertically movable second means adapted for extension between the object head and the workpiece for vertically pulling the object out of the workpiece, a slide member mounted on the slide mount for reciprocal movement to move the second means substantially parallel to the slide mount between an extended position that the second means is extendable between the workpiece and object head when the base member is pivoted about the fulcrum to extend upwardly and rearwardly and a retracted position whereby the object is separated from the workpiece, the second means being mounted to the slide mount for vertical movement therewith, and means connected between the slide mount and the slide member for vertically reciprocating the slide member between its positions.

9. The fastener puller of claim 8 wherein the slide member includes an annular portion having the slide mount extended therethrough, a piston rod connection portion joined to the annular portion to extend rearwardly of the annular portion and third means for mounting the second means forwardly of the slide mount, said third means being joined to the annular portion to extend forwardly of the slide mount, and the vertically reciprocating means includes a piston cylinder combination mount joined to the slide mount to extend rearwardly of the slide mount and a piston cylinder combination rearwardly of the slide mount and having one end connected to the combination mount and an opposite end connected to the third means for reciprocating the slide member.

10. A fastener puller of claim 9 wherein the second means includes a screw engaging portion longitudinally spaced from the slide mount approximately the same distance as the longitudinal spacing of the fulcrum from the slide mount.

11. A fastener puller for removing a screw or a similar object having a head from a deck or another workpiece into which the object extends, comprising a longitudinally and transversely extending base, an elongated main body joined to the base to extend vertically upwardly, vertically movable first means adapted for extension between the head and the workpiece for removing the object from the workpiece, and power operated means mounted to the main body for vertically reciprocating the first means between an extended position adapted for extension between the object head and the workpiece and a retracted object removed position, the base including transversely spaced, longitudinally elongated first and second legs having bottom surfaces, front end portions and rear end portions and a web joined to and extending between the legs rear end portions, the first means in its extended position, in part extending between the legs and being transversely spaced from the legs with the bottom surfaces of the first and second legs being abutable with the deck or the another workpiece, the first means including a slide member mounted to the main body for uni-axial movement relative to the main body, a shank portion connected to the slide member and a front portion, which extends forward from the shank portion, adapted for engaging the object and extending between the head and the workpiece, with the shank portion and the front portion being readily removably attached to the slide member and limited to concurrent uni-axial movement with the slide member relative to the main body, the first means having a maximum transverse dimension, and the legs having adjacent longitudinally extending edges that are transversely spaced from each other by a dimension that is many times greater than the first means maximum transverse dimension.

12. The fastener puller of claim 11, wherein the legs and web have respective bottom surfaces that are substantially in a common plane, the first means has a bottom surface, the area of the legs and web bottom surfaces is many times larger than the area of the first means bottom surface and the first means front portion bottom surface is forwardly spaced from the web by a distance that is at least about the same as the maximum transverse dimensions of the first means.

13. The fastener puller of claim 11, wherein the legs and web have respective bottom surfaces that are substantially in a common plane, and the transverse dimension of each leg is at least as great as the maximum transverse dimension of the first means.

14. The fastener puller of claim 11 wherein the adjacent longitudinally extending edges are transversely spaced from each other by a dimension that is at least five to ten times that of the first means maximum transverse dimension.

15. The fastener puller of claim 8 wherein the fulcrum providing means extends upwardly and forwardly of the front end portion.

16. A fastener puller for pulling a screw or a similar object having a head from a deck or another workpiece, comprising, in combination: a base; an elongated main body joined to the base to extend vertically upwardly, with the main body having an elongated slide mount; a slide member mounted on the slide mount for vertical reciprocal movement; a claw mounted to the slide member for movement therewith, with the claw having a bottom surface abutable with the workpiece; power operated means for vertically reciprocating the slide member along the slide mount between a claw extended position whereby the claw is movable between the object head and the workpiece and a claw retracted object removed position; and means secured to the base for receiving a pushing force by a user's foot when the slide member is in the claw extended position and the claw bottom surface extends parallel to the workpiece or slightly inclined downwardly in a direction toward the object for forcing the claw between the object head and the workpiece.

17. The fastener puller of claim 16 wherein the base includes a rear transverse web, with the pushing force receiving means comprising a transverse flange joined to the web and extending thereabove.

18. The fastener puller of claim 17 further comprising, in combination: a pair of wheels mounted to the base in transverse spaced relationship rearwardly of the transverse flange and above the plane of the transverse web.

19. The fastener puller of claim 18 wherein the base includes transversely spaced longitudinally extending flange portions extending above the plane of the transverse web, with the transverse flange extending between and joined to the longitudinally extending flange portions.

20. The fastener puller of claim 16 wherein the base includes a front end portion for providing a transverse fulcrum to facilitate the base being pivoted from a generally horizontal position to a tilted position to extend rearwardly and upwardly, with the pushing force receiving means being adapted to receive the pushing force when the base is in the tilted position.

21. The fastener puller of claim 16 wherein the claw in the claw extended position extends below the base and in the claw retracted position is located above the base.

* * * * *